US005126796A

United States Patent [19]

Fujii et al.

[11] Patent Number: 5,126,796

[45] Date of Patent: Jun. 30, 1992

[54] ELECTROPHOTOGRAPHIC RECORDING APPARATUS INCLUDING A PIVOTABLY MOUNTED AND ELASTICALLY SUPPORTED TRANSFER UNIT AND AUXILIARY ROLLER

[75] Inventors: Yasuo Fujii; Kouichirou Satou, both of Tokyo, Japan

[73] Assignee: Kabushiki Kaisha Toshiba, Kawasaki, Japan

[21] Appl. No.: 662,708

[22] Filed: Mar. 1, 1991

[30] Foreign Application Priority Data

Mar. 7, 1990 [JP] Japan ..... 2-55580
Mar. 20, 1990 [JP] Japan ..... 2-28772[U]

[51] Int. Cl.[5] ..... G03G 15/14
[52] U.S. Cl. ..... 355/271; 355/274
[58] Field of Search ..... 355/219, 221, 271, 273, 355/274, 276

[56] References Cited

U.S. PATENT DOCUMENTS 4,423,951 1/1984 Rightmyre ..... 355/274
4,466,729 8/1984 Iwata ..... 355/274 X
4,896,191 1/1990 Ohyabu et al. ..... 355/271 X
5,023,667 6/1991 Negoro et al. ..... 355/274

FOREIGN PATENT DOCUMENTS 0173078 7/1988 Japan ..... 355/274
0013571 1/1989 Japan ..... 355/271
0292380 11/1989 Japan ..... 355/274
0216164 8/1990 Japan ..... 355/274

*Primary Examiner*—A. T. Grimley
*Assistant Examiner*—William J. Royer
*Attorney, Agent, or Firm*—Finnegan, Henderson, Farabow, Garrett and Dunner

[57] ABSTRACT

A transfer unit has a plastic end block at each end. The end block includes a bearing for supporting an auxiliary roller, and an arm having at its end portion a pivot received by a lower casing. The bearing and the arm are formed integrally with the end block. A leaf spring located under the transfer unit supports it along with the roller in movable relationship around the pivot. When an upper casing is shut down, a photoreceptor drum supported in the upper casing pushes down the transfer unit against the elastic force of the leaf spring. Since the positions of the transfer unit and the roller are determined with respect to the photoreceptor drum, good duplicativity can be obtained. In this state, a cylindrical spacer serves to secure a predetermined space between the photoreceptor drum and the auxiliary roller.

5 Claims, 4 Drawing Sheets

ELECTROPHOTOGRAPHIC RECORDING APPARATUS INCLUDING A PIVOTABLY MOUNTED AND ELASTICALLY SUPPORTED TRANSFER UNIT AND AUXILIARY ROLLER

BACKGROUND OF THE INVENTION

1. Field of the Invention

The present invention relates to an electrophotographic recording apparatus based on electrostatic recording.

2. Description of the Related Art

In electrophotographic recording apparatuses of this type, information on an original document or the like is temporarily recorded as an electrostatic image on a photoreceptor drum, and the image is transferred to a recording sheet to record the information thereon. Initially, the surface of the drum is uniformly charged by means of a charger, and light is applied to the charged drum surface to remove electric charge thereon, thereby forming a charge image, in accordance with the information to be recorded. Then, a toner supplied from a developing unit is adhered to the charge image, thereby forming a toner image. In the meantime, a recording sheet is taken out from a paper cassette, and is delivered to a region between the photoreceptor drum, having the toner image thereon, and a transfer unit. Then, the sheet is electrostatically attracted to the drum by electric discharge from the transfer unit, and the toner image on the drum surface is transferred to the sheet. Subsequently, the recording sheet, having the toner image thereon, is heated by means of a fixing unit so that the toner is melted to fix the image on the sheet. On the other hand, the residual toner on the surface of the photoreceptor drum is removed by means of a cleaner to provide for the next cycle of recording.

Among the electrophotographic recording apparatuses arranged in this manner, some newly developed ones have a small auxiliary roller located just short of the photoreceptor drum, whereby the recording sheet can be brought more intimately into contact with the drum and the feed of the sheet is facilitated. Conventionally, in the apparatuses of this type, the transfer unit is disposed under the photoreceptor drum, aligning rollers are arranged on the upstream side of the drum with respect to the feeding direction of the recording sheet P, and a guide is interposed between the drum and the aligning rollers. The auxiliary roller 40 is situated between the guide and the transfer unit. A gear, which is in mesh with a gear on the photoreceptor drum, is provided on one end portion of the auxiliary roller. Also, a gear is provided on one end portion of one of the aligning rollers. Both these gears engage with a gear of a drive unit for rotation so that the photoreceptor drum, auxiliary roller, and aligning rollers rotate in association with one another.

Many of these recording apparatuses are of the clamshell type. The clamshell type is a type in which the apparatus housing comprises a lower casing and an upper casing swingably mounted thereon. In case of trouble, such as paper jamming, the upper casing can be swung open to give access to the internal mechanism to be inspected. Generally, in the clamshell-type recording apparatuses, a photoreceptor drum, charger, optical unit, developing unit, etc. are attached to the upper casing, and an auxiliary roller, transfer unit, etc. to the lower casing. It is to be desired that these members should be arranged in optimum positional relationships, in order to obtain satisfactory record images.

In the clamshell-type apparatuses, there are no special problems on the relative positions of members attached to a common body. The critical issue is the positional relationships between the members attached to the upper casing and the ones attached to the lower casing. It is difficult, however, to locate these members in optimum relative positions and maintain the optimum relationships. Since these relationships depend indirectly on the relative positions of the upper and lower positions joined together, they often vary from apparatus to apparatus due to assembly errors. In some cases, moreover, play at a bearing portion for supporting the upper casing may cause changes in the relative positions of the upper and lower casings, that is, in the respective positions of the transfer unit and the auxiliary roller relative to the photoreceptor drum. These variations or changes are undesirable negative factors for a technical object to provide fine-quality record images with stability.

SUMMARY OF THE INVENTION

The object of the present invention is to provide an electrophotographic recording apparatus capable of steadily producing fine-quality record images.

An electrophotographic recording apparatus has upper and lower casings, the upper casing is hinged on the lower casing. The apparatus comprises a photoreceptor drum supported in the upper casing, means for forming a toner image on the surface of the photoreceptor drum, means for guiding a recording sheet to the photoreceptor drum, a transfer unit located under the photoreceptor drum for transferring the toner image to the recording sheet and having an arm with a pivot supported by the lower casing, an auxiliary roller for feeding the recording sheet which is rotatably mounted on the transfer unit at the upstream side of the flow of the recording sheet, a disk-shaped spacer coaxially mounted on at least one of the photoreceptor drum and the auxiliary roller, and an elastic supporting member for urging the transfer unit along with the auxiliary roller against the photoreceptor drum so that the outer peripheral surfaces of the drum and the roller face each other across the spacer with the upper casing shut down.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

An embodiment of the present invention will now be described with reference to the accompanying drawings.

Figure 1:
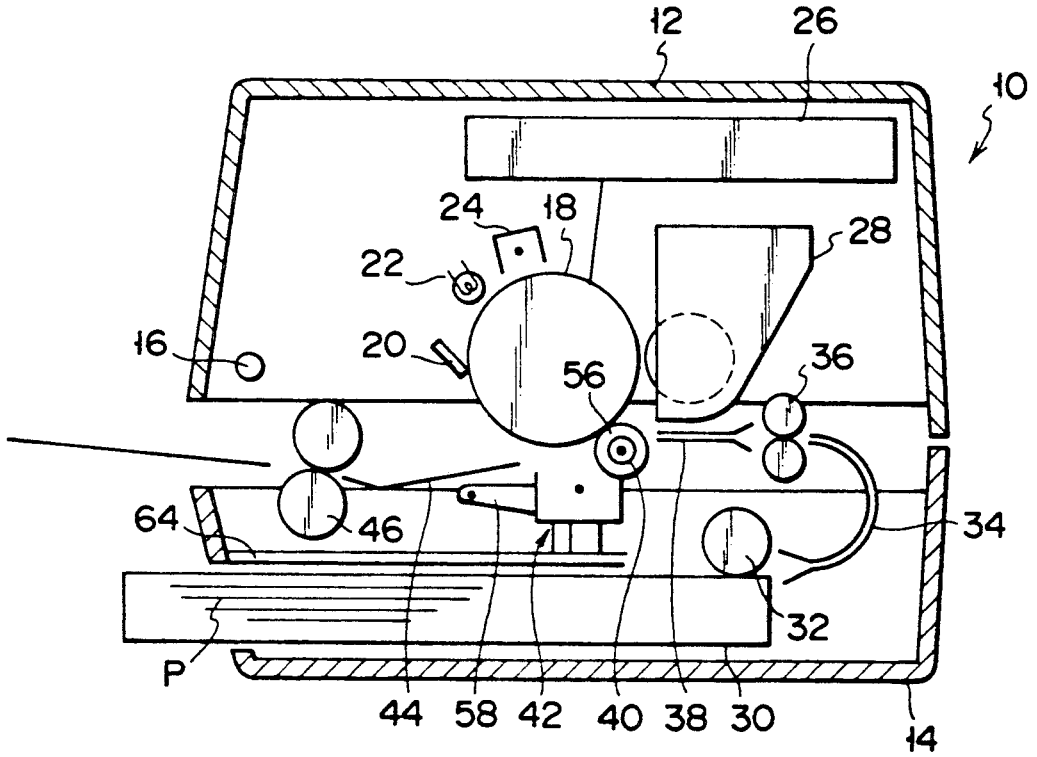
FIG. 1 schematically shows an outline of an electrophotographic recording apparatus according to the present invention in a closed state.
Figure 2:
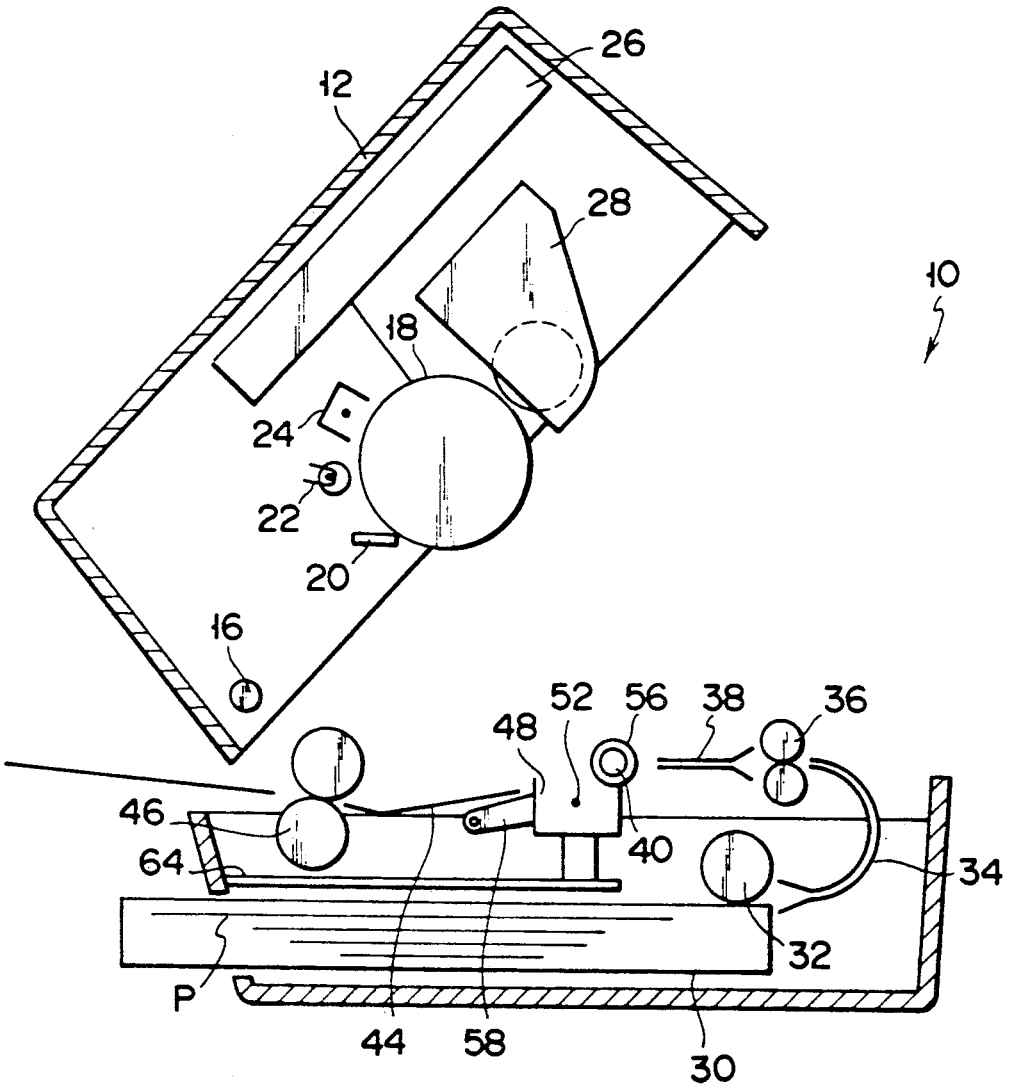
FIG. 2 schematically shows an outline of the apparatus in an open state.

As shown in FIGS. 1 and 2, an apparatus 10 comprises upper and lower casings 12 and 14. The upper casing 12 is swingably supported on the lower casing 14 by means of a pivot 16. A cylindrical photoreceptor drum 18 is horizontally disposed in the upper casing 12 for rotation. A cleaner 20, de-electrifier 22, main charger 24, optical unit 26, and developing unit 28 are arranged successively around the drum 18 in the rotating direction thereof. The lower casing 14 is provided with a paper-supply roller 32, guides 34 and 38, and aligning rollers 36, which serve as means for taking out recording sheets P one after another from a paper cassette 30 at the bottom portion of the casing 14 and delivering the sheets to the drum 18. An auxiliary roller 40 and a transfer unit 42 are located under the photoreceptor drum 18, and a fixing unit 46, along with a guide 44, is disposed on the downstream side of the elements 40 and 42.

Figure 3:
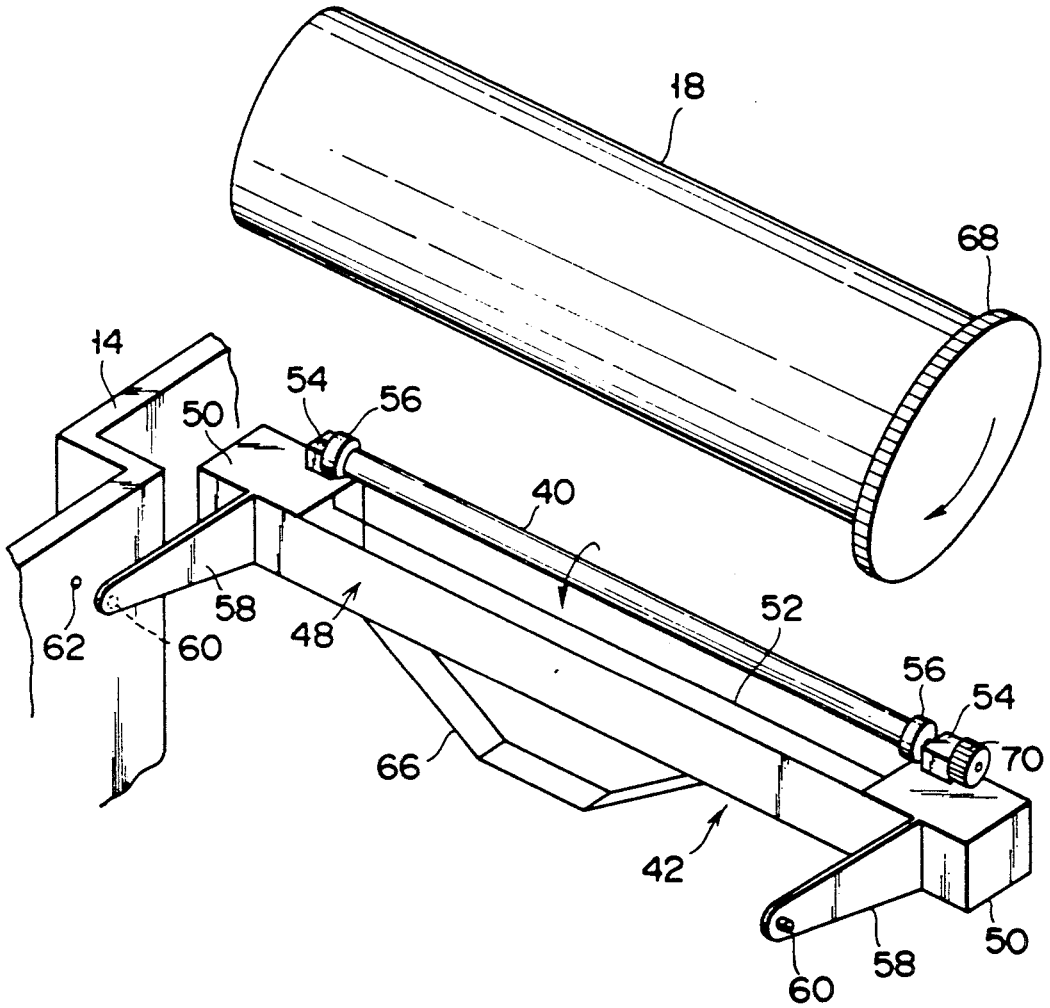
FIG. 3 is an enlarged partial perspective view of the apparatus shown in FIGS. 1 and 2, showing the arrangement of a transfer unit, an auxiliary roller, and their peripheral members.

Refer now to FIG. 3, which depicts a peripheral arrangement around the transfer unit 42 and the auxiliary roller 40, which constitute the principal mechanism of the present invention.

The transfer unit 42, which is of the corona discharge type, includes an electrically conductive frame 48 with a U-shaped cross section, and is as long as the photoreceptor drum 18. Plastic end blocks 50 are provided individually at two opposite ends of the frame 48, and a discharge electrode 52 in the form of a wire is stretched between the blocks 50.

A bearing 54 is provided on the top face of each end block 50 on the upstream side thereof where the aligning rollers 36 are situated. The auxiliary roller 40 is rotatably supported by means of the bearings 54. Cylindrical spacer 56, which serves as a spacing member to determine the size of the gap between the photoreceptor drum 18 and the auxiliary roller 40, is provided at each end of the roller 40. Each roller means 56 has a diameter larger than that of the roller 40, and the difference between the respective radii of the roller means 56 and the auxiliary roller 40 directly determines the gap between the drum 18 and the roller 40.

Each end block 50 is fitted integrally with an arm 58 which extends substantially at right angles to the side face of the frame 48, projecting on the downstream side thereof, that is, toward the fixing unit 46. A pivot 60 is formed integrally on the distal end portion of each arm 58 so as to project parallel to the discharge electrode 52 from the outside face of the arm 58.

The pivot 60 of each arm 58 is received by an opening 62 formed in each corresponding side wall of the lower casing 14. Thus, the transfer unit 42 and the auxiliary roller 40 are mounted on the casing 14 so as to be integrally vertically movable around the pivots 60. In this state, the transfer unit 42 is supported by means of an elastic supporting member, e.g., a V-shaped leaf spring 66 with two upwardly extending end portions, which is attached to an intermediate plate 64 (shown in FIGS. 1 and 2) of the lower casing 14. At this time, the unit 42 and the roller 40 are supported in a position above a proper position, and are pushed down to the proper position when the upper casing 12 is shut down. The photoreceptor drum 18 and the auxiliary roller 40 are fitted, on one end side thereof, with gears 68 and 70, respectively, which are adapted to engage each other when the upper casing 12 is shut down.

Figure 4:
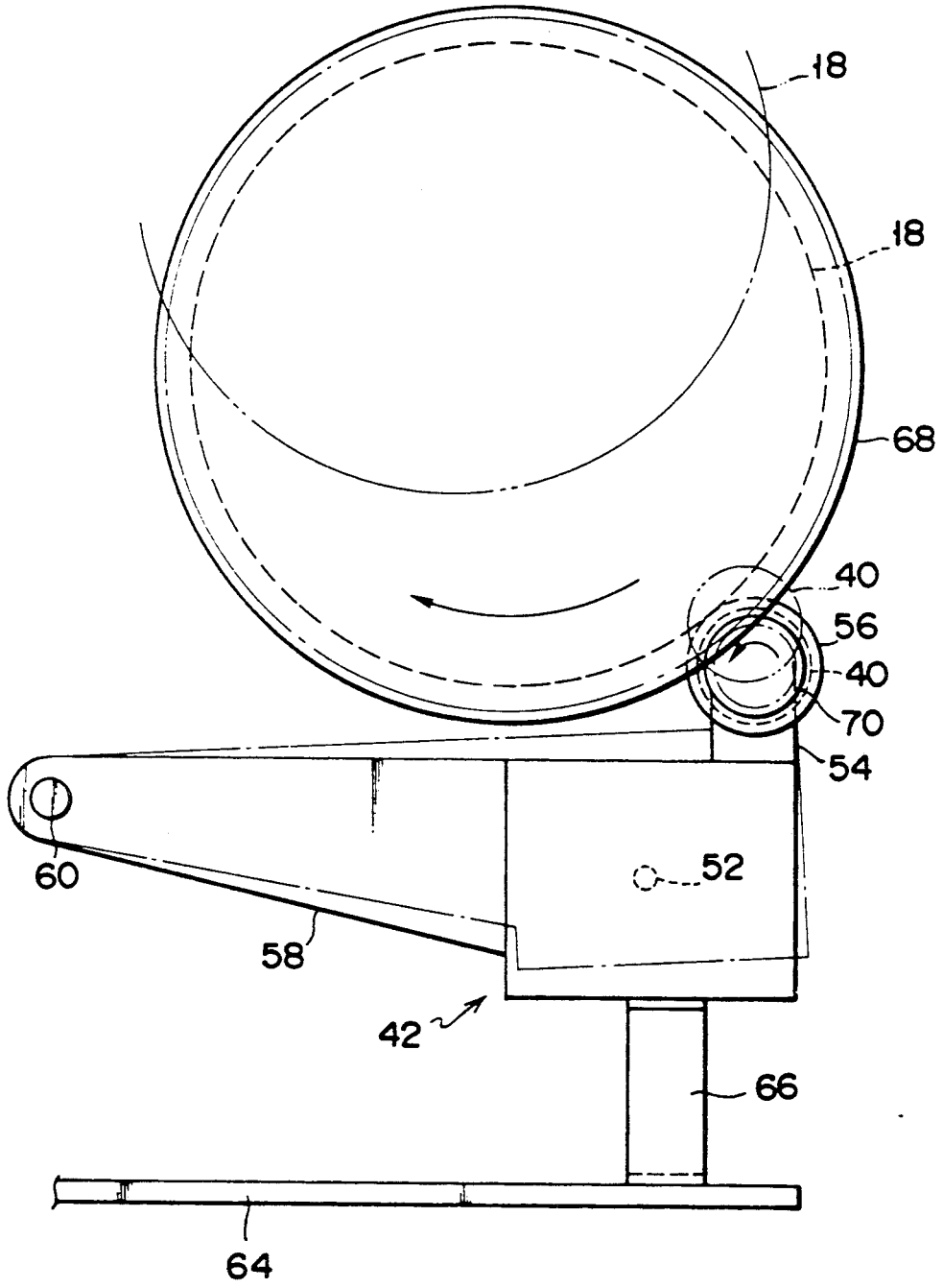
FIG. 4 is a diagram for illustrating the way the respective positions of the transfer unit and the auxiliary roller are determined relatively to the photoreceptor drum.

Referring now to FIG. 4, the way of positioning the transfer unit 42 and the auxiliary roller 40, with respect to the photoreceptor drum 18, will be described.

When the upper casing 12 is off, the transfer unit 42 and the auxiliary roller 40 are supported in the positions indicated by imaginary lines in FIG. 4. When the casing 12 is shut down, the outer peripheral surface of the photoreceptor drum 18 engages the roller means 56 before the casing 12 is fully lowered. As the casing 12 is lowered in this manner, the drum 18 is further lowered, so that the transfer unit 42 and the auxiliary roller 40 are pressed down against the elastic force of the leaf spring 66. The position of the unit 42 reached when the upper casing 12 is fully shut down is indicated by full line, while the respective positions of the drum 18 and the roller 40 in the same state are indicated by broken lines in FIG. 4. Thus, a space of the size equal to the difference between the respective radii of the roller means 56 and the roller 40 is secured between the drum 18 and the roller 40. In this state, the photoreceptor drum 18 and the auxiliary roller 40 are allowed to rotate in association with each other, having the gears 68 and 70 on their respective end portions engaged with each other. If the upper casing 12 is lifted so that the drum 18 reaches the position indicated by imaginary line, the transfer unit 42 and the auxiliary roller 40 are pushed up again to the positions indicated by the imaginary line by means of the elastic force of the leaf spring 66.

According to this arrangement, the transfer unit 42 and the auxiliary roller 40 have a degree of freedom such that they can move up and down around the pivots 60 of the arms 58, and their respective positions reached when the upper casing 12 is shut down are determined relatively to the position of the photoreceptor drum 18 by means of the roller means 56. If the position of the upper casing 12 relative to the lower casing 14, that is, the position of the drum 18, varies therefore, the respective positions of the transfer unit 42 and the auxiliary roller 40 relative to the drum 18 never change. Thus, the unit 42 and the roller 40 are always kept at their respective optimum positions with respect to the drum 18. These optimum positions are determined in the stage of designing, depending on various factors, so that the recording sheets P can be effectively electrostatically attracted to the photoreceptor drum 18. In order to locate the transfer unit 42 and the auxiliary roller 40 in their optimum positions, the relative positions of the pivots 60 of the arms 58 and the bearings 54 of the roller 40 should be accurately determined. This can be easily achieved by integrally forming the arms 58, pivots 60, and bearings 54, along with the end blocks 50, from synthetic resin. Preferably, PBT (polybutylene terephthalate), which is highly resistant to ozone and abrasion, or POM (polyacetal) in the form of a copolymer is used as the material of the end blocks 50.

Although the auxiliary roller is provided with the cylindrical spacer 56 for use as the space defining member according to the present embodiment, the roller means may alternatively be formed on the photoreceptor drum or on each of the auxiliary roller and the drum.

According to the apparatus of this type, record images may inevitably be subject to unevenness in optical density under some conditions. This unevenness in optical density includes streaks which are formed at regular pitches when halftone recording is executed, for example. The inventors hereof made many studies of this undesired phenomenon to clear up the cause of it, and found out a countermeasure to prevent it. These studies will be explained after describing a recording operation with reference to the drawing of FIG. 1 as follows.

Before starting image recording, the surface of the photoreceptor drum 18 is first uniformly charged by means of the main charger 24. Light is selectively applied to the drum surface by means of the optical unit 26, thereby removing electric charge from the surface. As a result, a charge image corresponding to an information to be recorded is formed on the surface of photoreceptor drum 18. A toner is adhered to the charge image by means of the developing unit 28, whereupon a toner image to be transferred afterward to the recording sheet P is formed. Meanwhile, the sheet P is picked up from the paper cassette 30 and delivered along the guide 34 to the aligning rollers 36 by means of the paper-supply roller 32. Thereupon, the leading end of the sheet P abuts against the rollers 36, which are then at a standstill, so that the sheet is somewhat bent. Thereafter, the aligning rollers 36 start to rotate relatively to photoreceptor drum 18 with a predetermined timing, thereby feeding the recording sheet P forward. Thus, if the sheet P is skewed when it is delivered to the rollers 36, its leading end is reoriented by abutting against the rollers 36. Accordingly, the recording sheet P can be delivered in a correct direction from the aligning rollers 36. The sheet P, thus delivered from the rollers 36, is transported along the guide 38 to the auxiliary roller 40. As the roller 40 rotates, the sheet P is delivered to the photoreceptor drum 18. Then, the sheet P is electrostatically attracted to the drum 18 by corona discharge from the transfer unit 42, and the toner image on the drum surface is transferred to the sheet P by means of a Coulomb force. After the toner image is fixed to the recording sheet P by means of the fixing unit 46, the sheet P is discharged from the apparatus. To provide for the next cycle of image recording, the toner and electric charge remaining on the surface of the drum 18 are removed by means of the cleaner 20 and the de-electrifier 22, respectively.

While the toner image on the photoreceptor drum 18 is being transferred to the recording sheet P, the sheet is transported by means of the auxiliary roller 40 and the drum 18. The moving speed of the sheet P depends on the respective peripheral speeds of the roller 40 and the drum 18. If there is a great difference between these two peripheral speeds, the recording sheet P periodically flutters, thereby causing unevenness in the optical density of the resulting record image. In order to obtain a satisfactory record image, therefore, irregular movement of the recording sheet P should be restrained. To attain this, it is advisable to adjust the ratio K between the respective peripheral speeds of the photoreceptor drum 18 and the auxiliary roller 40 as follows:

$$0.99 < K < 1.01.$$

These are findings obtained as a result of the studies made by the inventors hereof.

The studies will now be described in detail. The ratio K (=V2/V1) between the respective peripheral speeds V1 and V2 of the photoreceptor drum 18 and the auxiliary roller 40 is given by $$K = (D2 \cdot d1)/(D1 \cdot d2) = (D2 \cdot Z1)/(D1 \cdot Z2),$$

where D1 is the diameter of the drum 18, m1 is the module of the gear 68 on the drum 18, d1 is the pitch diameter, and Z1 is the number of teeth. Record images were evaluated with respect to the value of the ratio K on the assumption that the rotational frequency of the photoreceptor drum 18 was 30.2 rpm. Thereupon, streaks sometimes appeared on the record images when the value of the ratio K was smaller than 0.99 or greater than 1.01. Accordingly, the inventors hereof concluded that it is advisable to set the value of the ratio K within the range $0.99 < K < 1.01$, in order to obtain satisfactory record images.

If the space between the respective peripheral surfaces of the photoreceptor drum 18 and the auxiliary roller 40 is too wide, moreover, the effect of the roller 40 to facilitate the feed of the recording sheet P is lowered. Preferably, therefore, the space between the surfaces is adjusted so that there is a relation $\{(d1+d2)-(D1+D2)\}/2 \leqq 1.45$.

In order to prevent the leading end of the recording sheet P from abutting directly against the auxiliary roller 40, that is, to enable smooth feed of the sheet P, furthermore, a height h of the top point of the roller 40 above the forward end of a lower plate of the guide 38 is preferably set within the range $0 \leqq h \leqq 0.5$ mm.

The following specific sizes were used by way of example. The diameter D1 of the photoreceptor drum 18 used was 40 mm, the module m1, number of teeth Z1, and pitch diameter d1 of the gear 68 were 0.5, 85, 42.5 mm, respectively, and the module m2, number of teeth Z2, and pitch diameter d2 of the gear 70 were 0.5, 12, and 6 mm, respectively. The rotational frequency of the drum 18 was adjusted to 30.2 rpm. On the other hand, five auxiliary rollers 40 with different diameters were prepared, and the values of K for these individual rollers 40 were calculated. By doing this, those values of the diameter D2 of the rollers 40 which fulfill the condition $0.99 < K < 1.01$ were examined. The value of the ratio K (=V2/V1) of the peripheral speed of the auxiliary roller 40 to that of the photoreceptor drum 18 can be obtained as follows:

$$K = D2/D1 \times d1/d2 = 42.5/40 \times D2/6.$$

The values of the diameter D2 of the individual auxiliary rollers were 5.6 mm, 5.65 mm, 5.7 mm, 5.75 mm, and 5.8 mm, and the values of the ratio K for these diameter values were 0.992, 1.001, 1.009, 1.018, and 1.027, respectively. With respect to the aforementioned requirements, therefore, it may be understood that the value of the ratio K can be restricted within the range $0.99 < K < 1.01$ as long as the diameter of the auxiliary roller 40 ranges from 5.6 mm to 5.7 mm.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrophotographic recording apparatus which has upper and lower casings arranged so that the upper casing is liftable from the lower casing, comprising:

a photoreceptor drum supported by means of the upper casing;

means for forming a toner image on the surface of the photoreceptor drum;

means for guiding a recording sheet to the photoreceptor drum;

a transfer unit for electrical discharge located under the photoreceptor drum and adapted to transfer the toner image to the recording sheet;

an auxiliary roller for feeding the recording sheet, said auxiliary roller being rotatably mounted on the transfer unit so as to be situated in a position fixed with respect to the transfer unit and on the upstream side with respect to the flowing direction of the recording sheet;

an arm extending from the transfer unit and having a pivot supported by the lower casing;

a disk-shaped space defining member coaxial with the photoreceptor drum and/or the auxiliary roller; and an elastic supporting member for urging the transfer unit and the auxiliary roller against the photoreceptor drum so that the respective outer peripheral surfaces of the drum and the roller face each other across the space defining member when the upper casing is shut down.

2. The electrophotographic recording apparatus according to claim 1, wherein said transfer unit includes an electrically conductive frame having a U-shaped cross section, plastic end blocks provided individually at two opposite ends of the frame, and a discharge electrode in the form of a wire stretched between the blocks, each said end block including a bearing for receiving the auxiliary roller and an arm formed integrally with the bearing.

3. The electrophotographic recording apparatus according to claim 2, wherein said elastic supporting member is a leaf spring attached to the lower casing.

4. The electrophotographic recording apparatus according to claim 1, wherein said photoreceptor drum and said auxiliary roller are provided individually, on one end side thereof, with gears which are adapted to engage each other when the upper casing is shut down, whereby $0.99 < K < 1.01$ is fulfilled, where K is the ratio between the respective peripheral speeds of photoreceptor drum and the auxiliary roller in rotation.

5. The electrophotographic recording apparatus according to claim 4, wherein the rotating speed of the photoreceptor drum is 30.2 rpm.

* * * * *